US006651280B2

(12) United States Patent
Blevins

(10) Patent No.: US 6,651,280 B2
(45) Date of Patent: Nov. 25, 2003

(54) PATIENT LIFTER

(76) Inventor: Jerry Blevins, 109 Farm Hill Dr., Toms Brook, VA (US) 22660

( * ) Notice: Subject to any disclaimer, the term of this patent is extended or adjusted under 35 U.S.C. 154(b) by 69 days.

(21) Appl. No.: 09/864,823

(22) Filed: May 16, 2001

(65) Prior Publication Data

US 2001/0044965 A1 Nov. 29, 2001

Related U.S. Application Data

(60) Provisional application No. 60/204,549, filed on May 16, 2000.

(51) Int. Cl.[7] ..... A61G 7/012; A61G 7/05

(52) U.S. Cl. ..... 5/611; 5/81.1 R; 5/86.1; 414/921

(58) Field of Search ..... 5/81.1 R, 83.1, 5/86.1, 611, 625; 414/678, 921

(56) References Cited

U.S. PATENT DOCUMENTS 4,719,655 A * 1/1988 Dean ..... 5/86.1
5,319,817 A * 6/1994 Hay et al. ..... 5/611
5,487,195 A * 1/1996 Ray ..... 5/83.1
5,509,152 A * 4/1996 Kippes ..... 5/81.1 R
6,329,612 B1 * 12/2001 von Schroeter ..... 5/83.1
6,430,761 B1 * 8/2002 Brandorff et al. ..... 5/86.1

FOREIGN PATENT DOCUMENTS

GB 2222814 * 3/1990 ..... 5/86.1

* cited by examiner

*Primary Examiner*—Jong-Suk Lee
(74) *Attorney, Agent, or Firm*—Hoffman, Wasson & Gitler, PC

(57) ABSTRACT

A patient lifter has a patient support platform that made be lowered until it touches the floor. Once in this position, it is a simple matter for a single person to place a patient who is prone on the floor onto the patient platform. Once on the platform, the patient support platform can be raised to a height sufficient to transfer the patient onto a bed or chair. The invention has many different devices for raising and lowering the patient support platform which may be chosen. The device is provided with wheels so that it may be easily transported to the site of the patient and be used to move the patient from place to place.

6 Claims, 13 Drawing Sheets

FIG. 2
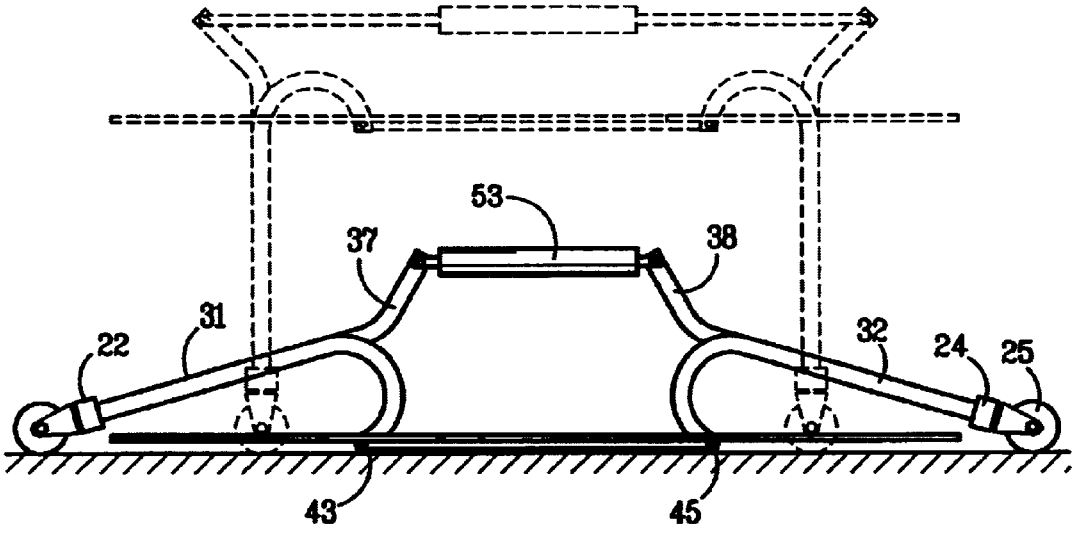
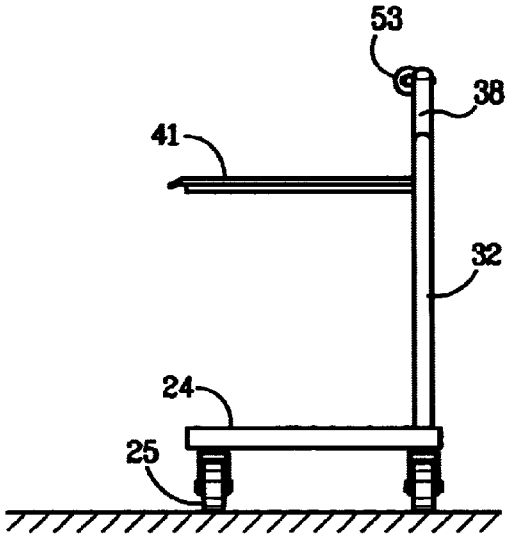
FIG. 3
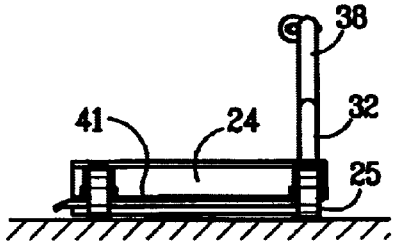
FIG. 4

FIG. 5
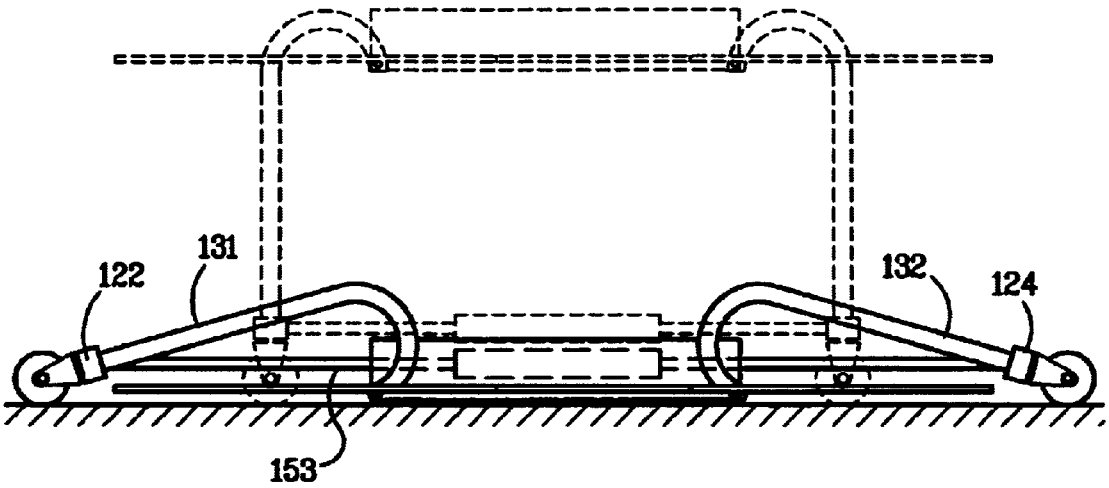
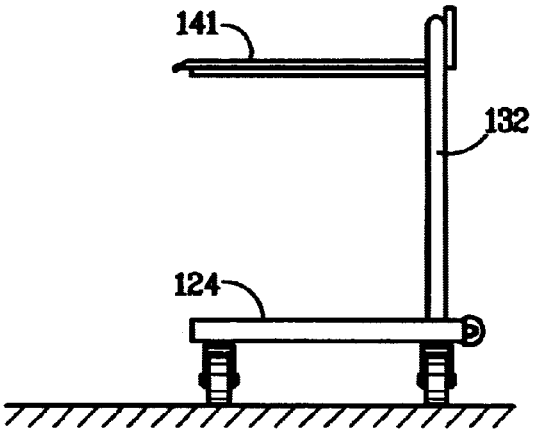
FIG. 6
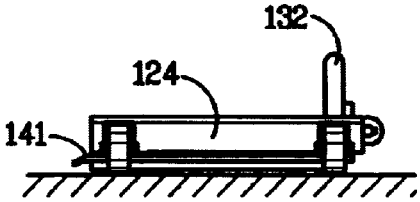
FIG. 7

FIG. 8
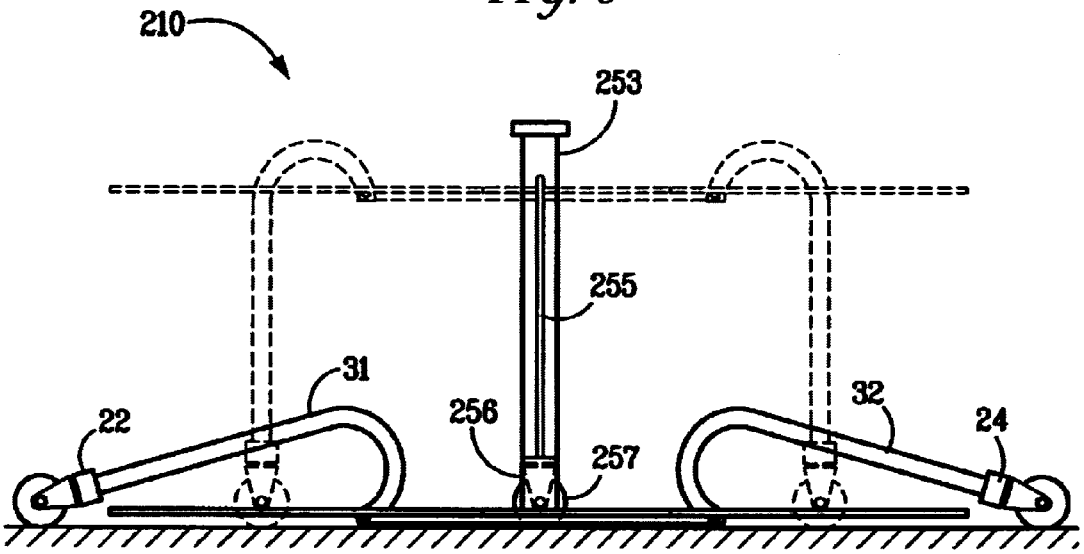
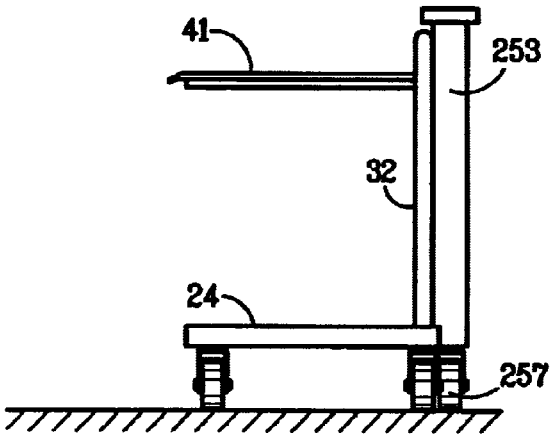
FIG. 9
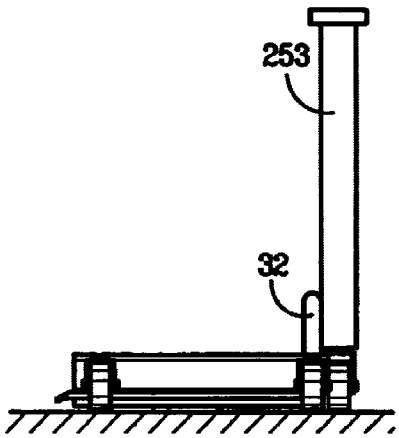
FIG. 10

FIG. 11
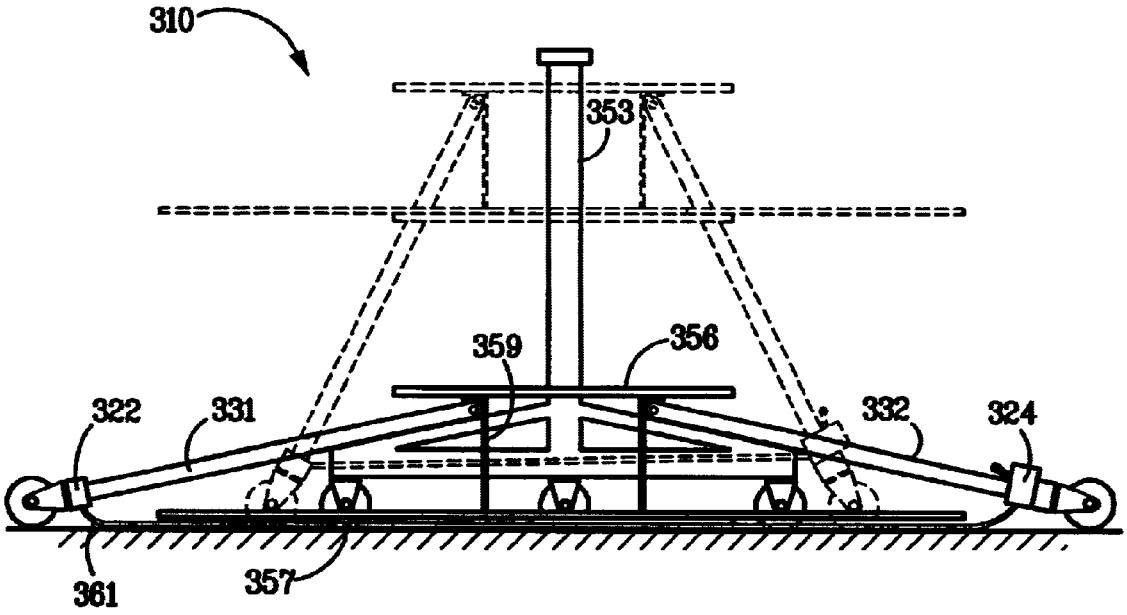
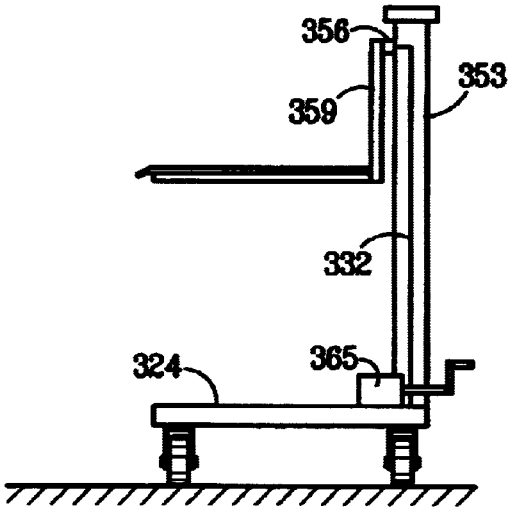
FIG. 12
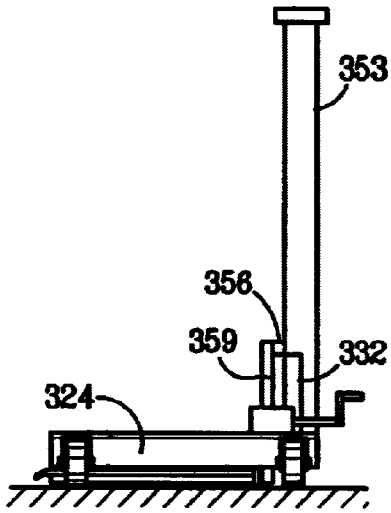
FIG. 13

FIG. 14
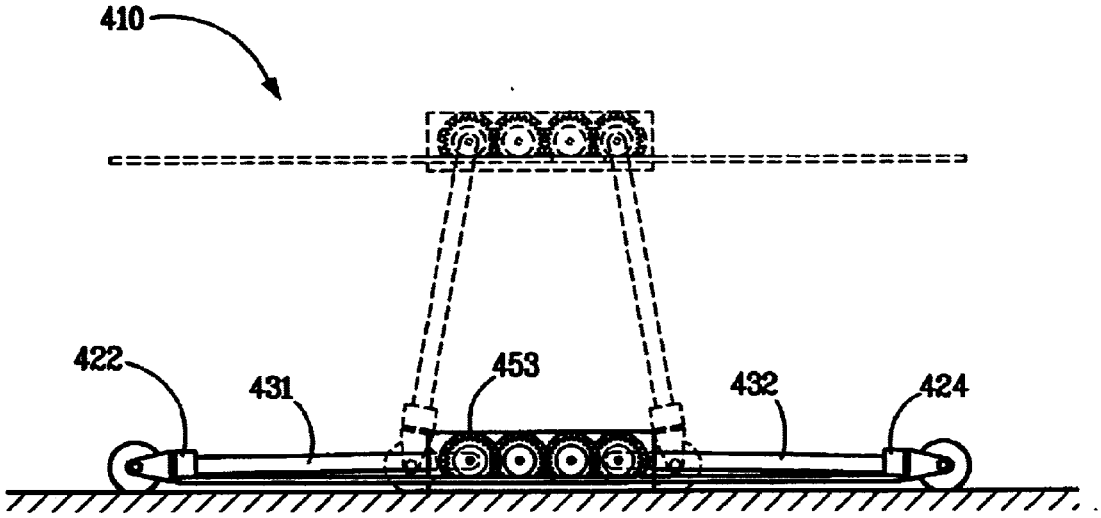
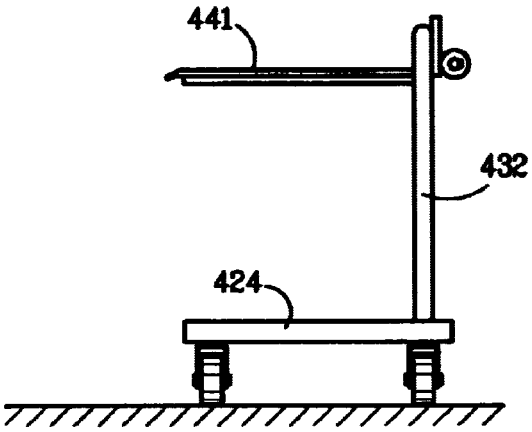
FIG. 15
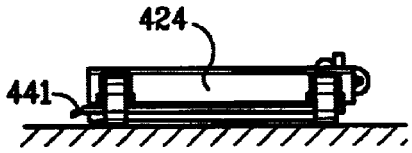
FIG. 16

FIG. 17
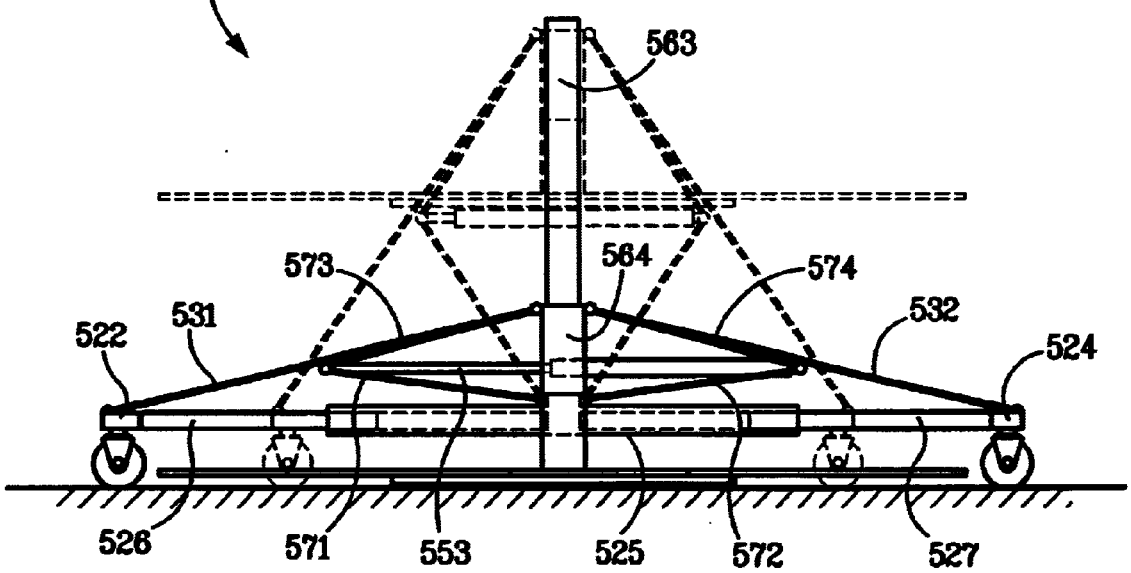
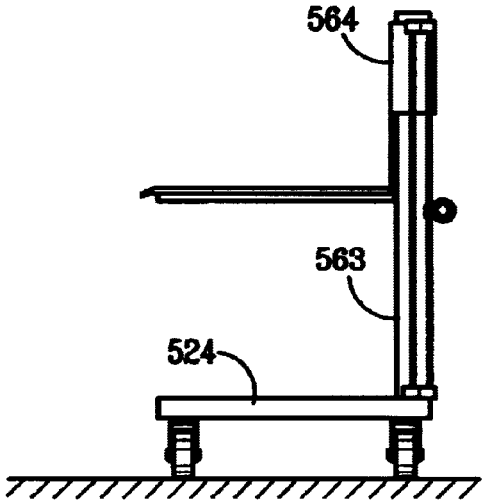
FIG. 18
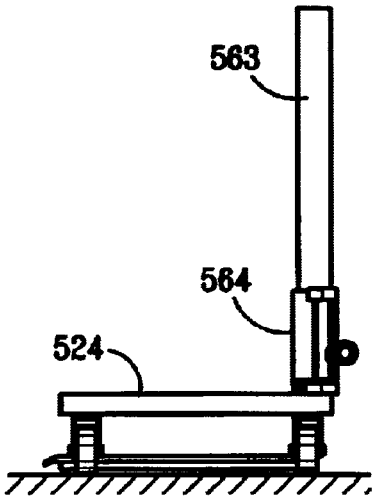
FIG. 19

FIG. 20
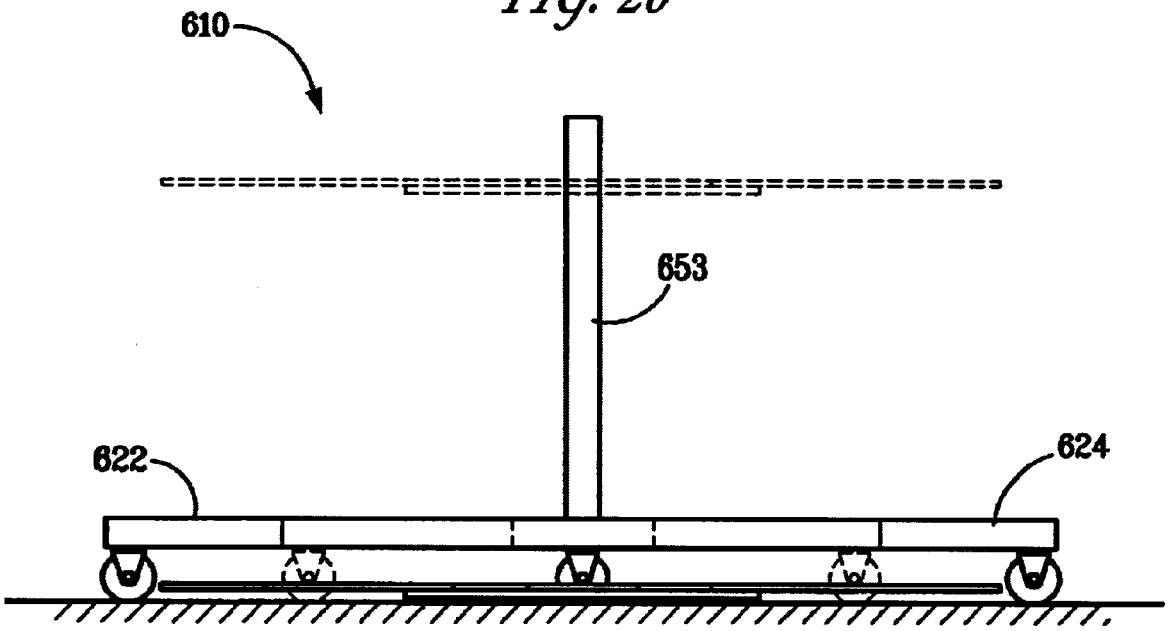
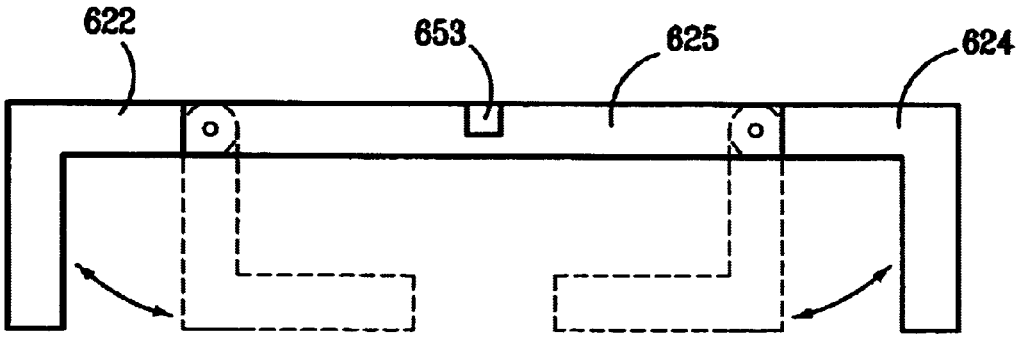
FIG. 21

FIG. 22
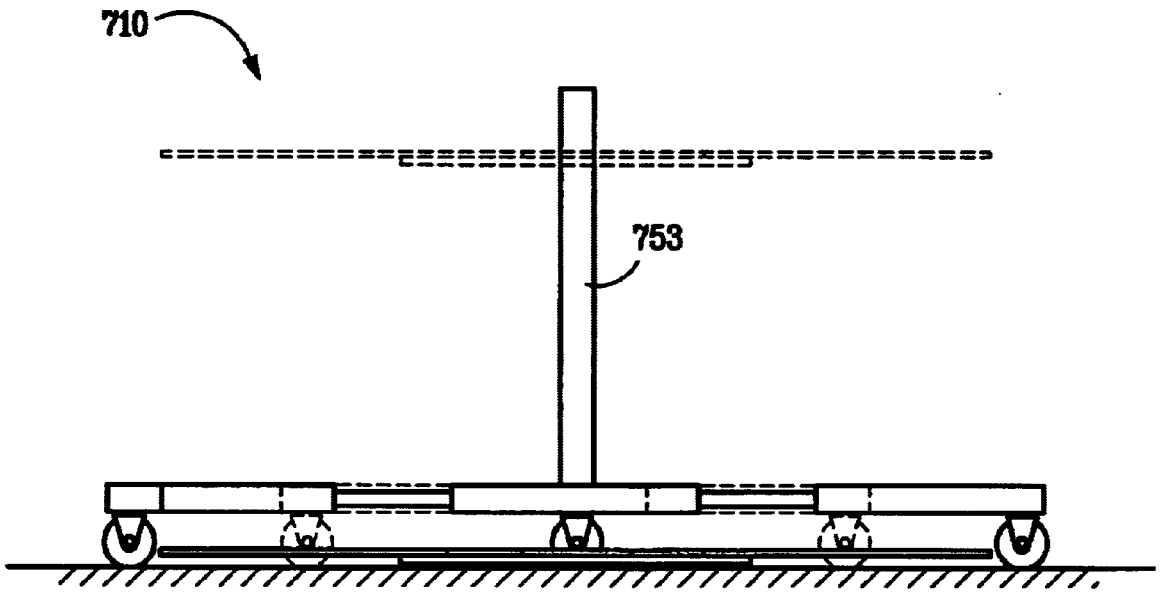
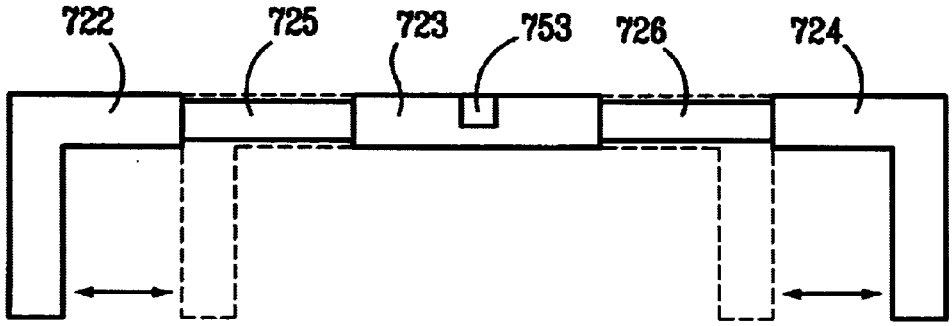
FIG. 23

FIG. 24
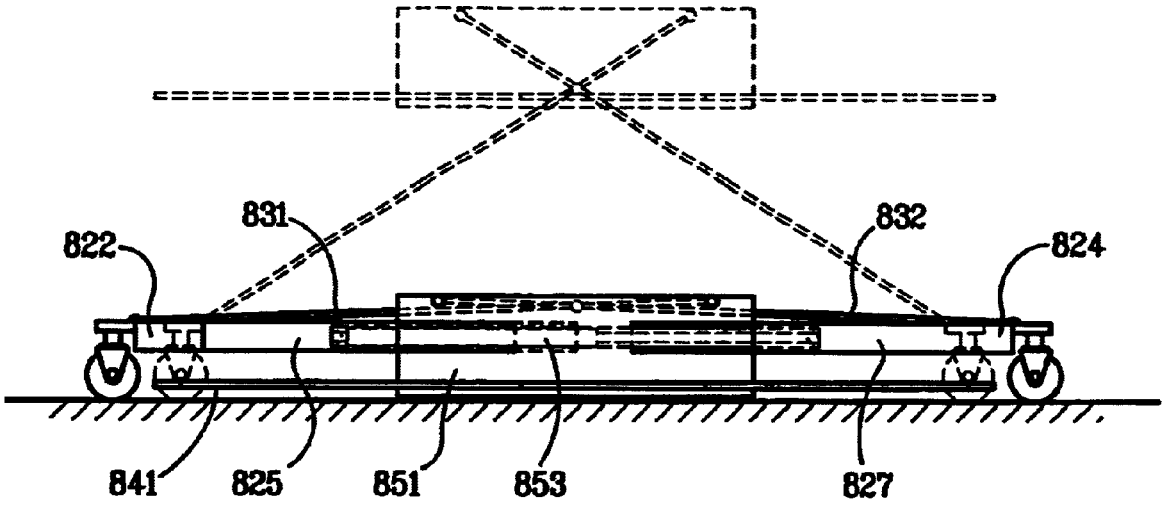
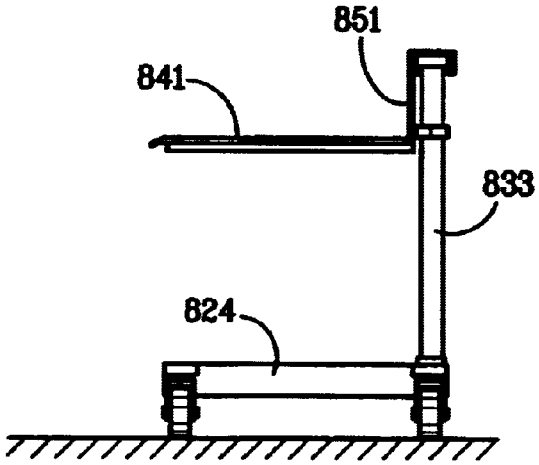
FIG. 25
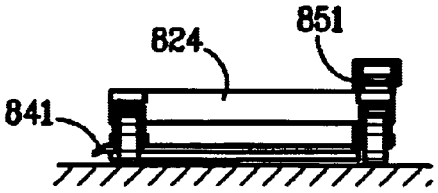
FIG. 26

FIG. 33
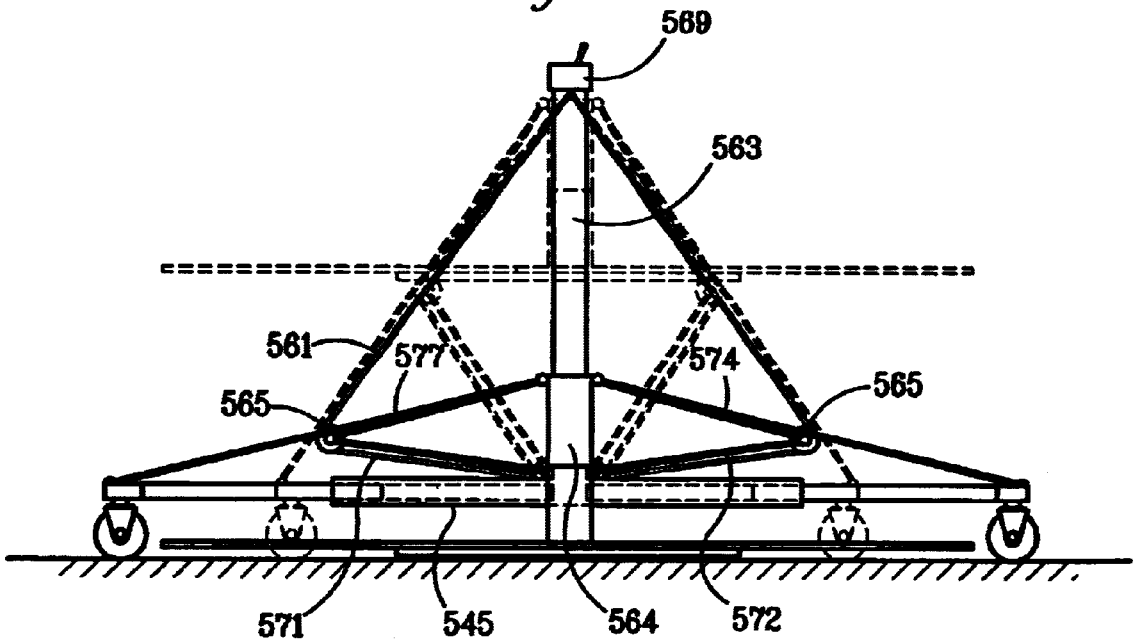
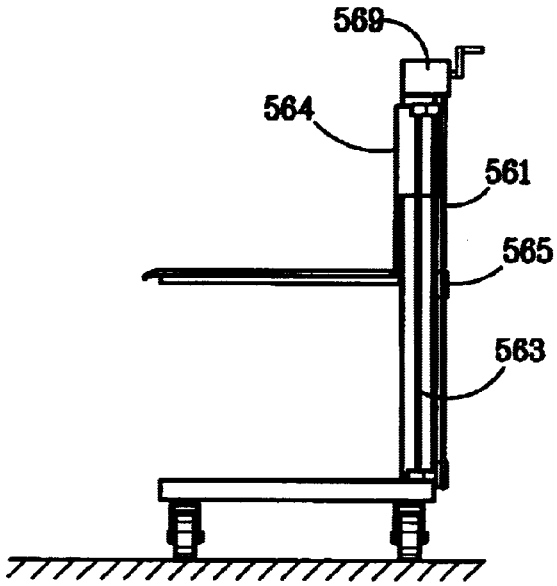
FIG. 34
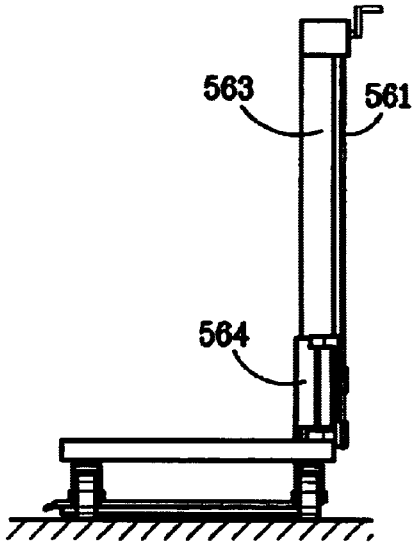
FIG. 35

PATIENT LIFTER

This application claims benefit of provisional application 60/204,549, filed May 16, 2000.

BACKGROUND OF THE INVENTION

On occasion, immobile patients fall from a bed or chair onto the floor. It is often difficult to get the patient to their original position when they are in a prone position on the floor. It often takes several people in order to safely lift a patient from the floor and successfully back to their original position. Most prior art devices are used to transfer a patient from an original position on a bed or chair and do not extend their support surface to the floor. Without a support surface that extends to the floor, a patient on the floor needs to be manually lifted to a support surface in order to move the patient.

It is an object of the invention to provide a patient lifter that has a support surface that can extend downwardly to floor level.

It is another object of the invention to provide a patient lifter that can safely and easily lift a patient from a prone position on the floor.

It is yet another object of the invention to provide a patient lifter that is possible for a single person to use.

It is yet another object of the invention to provide a patient lift system that is easy and inexpensive to operate.

These and other objects of the invention will become apparent to one of ordinary skill in the art after reviewing the disclosure of the invention.

SUMMARY OF THE INVENTION

A patient lifter has a patient support platform that made be lowered until it touches the floor. Once in this position, it is a simple matter for a single person to place a patient who is prone on the floor onto the patient platform. Once on the platform, the patient support platform can be raised to a height sufficient to transfer the patient onto a bed or chair. The invention has many different devices for raising and lowering the patient support platform which may be chosen. The device is provided with wheels so that it may be easily transported to the site of the patient and be used to move the patient from place to place. The device can also be used to transfer a patient between beds. In this way, any difference in height between the beds does not pose a problem.

BRIEF DESCRIPTION OF THE DRAWINGS

FIG. 2 is a front view of the invention in the lowered position with the raised position shown in phantom;

FIG. 3 is a side view of the device in the upright position;

FIG. 4 is a side view of the device in the lowered position;

FIG. 5 is a front view of a second embodiment of the invention in the lowered position, with the raised position shown in phantom;

FIG. 6 is a side view of the second embodiment of the device in the upright position;

FIG. 7 is a side view of the second embodiment of the device in the lowered position;

FIG. 8 is a front view of a third embodiment of the invention in a deployed position with the raised position shown in phantom;

FIG. 9 is a side view of the third embodiment of the device in the upright position;

FIG. 10 is a side view of the third embodiment of the device in the lowered position;

FIG. 11 is a front view of a fourth embodiment of the invention in the lowered position with the raised position shown in phantom;

FIG. 12 is a side view of the fourth embodiment of the device in the upright position;

FIG. 13 is a side view of the fourth embodiment of the device in the lowered position;

FIG. 14 is a front view of a fifth embodiment of the invention in the lowered position with the raised position shown in phantom;

FIG. 15 is a side view of the fifth embodiment of the device in the upright position;

FIG. 16 is a side view of the fifth embodiment of the device in the lowered position;

FIG. 17 is a front view of a sixth embodiment of the invention in the lowered position with the raised position shown in phantom;

FIG. 18 is a side view of the sixth embodiment of the device in the upright position;

FIG. 19 is a side view of the sixth embodiment of the device in a deployed position;

FIG. 20 is a front view of a seventh embodiment of the invention in the lowered position with the raised position shown in phantom;

FIG. 21 is a top view of the seventh embodiment of the invention with the collapsed position of the base shown in phantom;

FIG. 22 is a front view of an eighth embodiment of the invention in the lowered position with the raised position shown in phantom;

FIG. 23 is a top view of the eighth embodiment of the invention in the lowered position, with the upright position shown in phantom;

FIG. 24 is a front view of a ninth embodiment of the invention in the lowered position with the raised position shown in phantom;

FIG. 25 is a side view of the ninth embodiment of the device in the upright position;

FIG. 26 is a side view of the ninth embodiment of the device in the lowered position;

FIG. 33 is a front view of an twelfth embodiment of the invention;

FIG. 34 is an exploded view of the patient support platform of the twelfth embodiment; and FIG. 35 is a front view of the twelfth embodiment of the device in the lowered position.

DETAILED DESCRIPTION OF THE INVENTION

Figure 1:
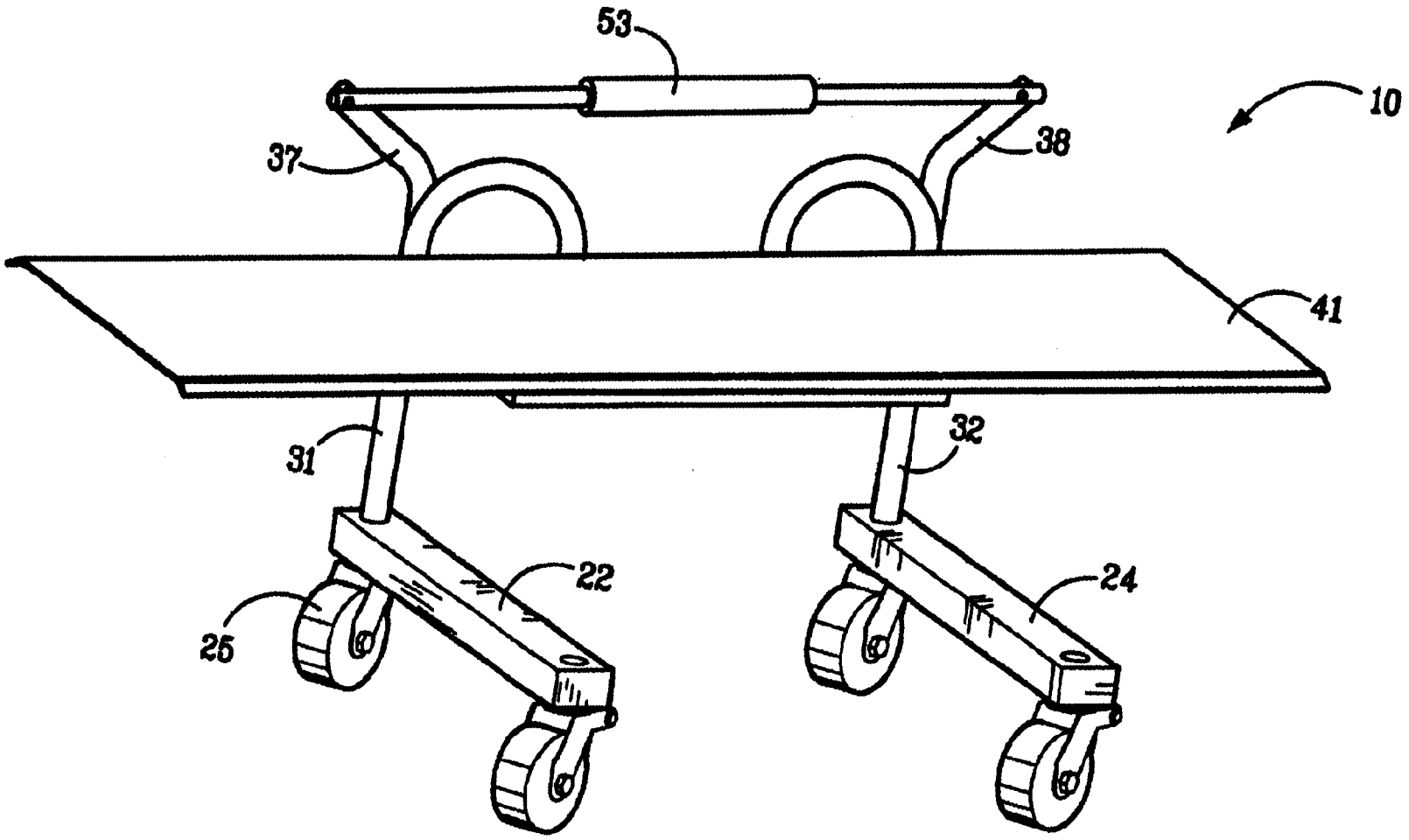
FIG. 1 is a perspective view of the invention.

The invention will now be described, beginning with reference to FIG. 1. As seen in this figure, the patient lifter has two horizontally extending tubular members 22, 24. The tubular members are provided with wheels 25 to form the base. The wheels not only allow the movement of the patient lifter from location to location, but also aid in the operation in the device, as will be described later. Extending upwardly from each of the tubular members is a vertical support 31, 32. The vertical supports attach to, and support, a patient support platform 41 in a cantilevered fashion.

The tubular members extend from the vertical supports in the same direction as the patient support platform. In this way, the members prevent the patient lifter from tipping over, even when a patent is placed on the platform 41. The vertical supports are connected at joints 43, 45 to the patient support platform to allow relative pivoting movement between the elements that is necessary for the patient lifter to operate.

Each vertical support has an extension 37, 38. The extensions extend upwardly from the vertical support at an angle so as to diverge from one another. Connected between the vertical supports is an actuating piston 53. The actuating piston 53 has a main body and two ends connected to the extensions 37, 38. This connection also allows relative pivoting motion between the piston and extensions, as will be described hereinafter.

The patient support platform 41 is rectangular in shape, as in conventional for any surface designed to support a person in a reclined position. One of the long sides of the platform is attached to the vertical supports and extends from the vertical supports in a cantilever fashion. The opposite long side of the platform remains open for the easy transfer of a patient onto the platform. When the patient support platform is lowered to be in contact with the ground, a patient is transferred from the floor to the platform by moving the patient onto the platform along the open long side. The open long side of the platform can have a removable railing to prevent a patient from falling from the patient platform after it has been raised from the floor.

The method of operation of the patient lifter is seen in FIGS. 2–4. In FIG. 2, the patient lifter in its lowered position with the upright position shown in phantom. To operate the system, the piston 53 is actuated so that the ends of the piston are drawn inwardly, thereby reducing the distance between the extensions 37, 38. As this distance decreases, the vertical supports 31, 32, pivot about joints 43, 45 between the vertical supports and patient support platform 41. As the distance between the extensions 37, 38 decreases, the distance between the vertical supports below the pivoting connection increases. The result is that the distance between tubular members 22, 24 of the base increases. As this distance increases, the wheels 25 allow the smooth, easy translations of these elements away from one another. As this occurs, the patient support platform 41 is lowered in elevation until it reaches the floor. Once in this position, it is a simple matter to transfer a patient from the floor onto the patient support platform 41. When it is desired to raise the patient lifter back to its original position, the piston 53 is again actuated and the ends push outwardly to increase the distance between the extensions 37, 38. As this occurs, the tubular members 22, 24 are drawn to one another as the vertical supports 31, 32 again pivot about its connection 43, 45 to the patient support platform 41.

FIG. 3 shows a side view of the patient lifter in its upright position. In this view, it can seen that the patient support platform 41 is spaced above the ground and the wheels 25 are completely underneath the tubular member 24. The vertical support 32 extends vertically upwardly from the tubular base member 24. In FIG. 4, the lowered position of the patient lifter is seen in a side view. As can be readily seen, the patient support platform 41 is now lowered to the floor and the wheel 25 is located to the side of the tubular member 24. The vertical member 32, forming an angle with the floor, has a reduced vertical extent.

A second embodiment of the patient lifter is shown in FIG. 5. In this embodiment, an actuating piston 153 extends between the tubular base members 22, 24. In this instance, the effective length of the piston 153 is increased in order to increase the distance between the tubular members 22, 24 and lower the patient support surface 41. The vertical supports 31, 32 are pivotally connected to the patient support system, but do not have any extension.

The side view of the patient support lifter is seen in FIG. 6. In this figure, the patient lifter is in the upright position with the patient support surface 41 spaced well above the floor. After actuation of the piston 153, and the lowering of the patient support system 41, the patient lifter has the configuration shown in FIG. 7. As can be seen, the patient support platform 41 is touching the ground and the wheels 25 are now situated to the side of the tubular base members 24 from their original position underneath the tubular base members 24. Any conventional means can be used.

Turning now to FIG. 8, a third embodiment of the patient lifter is seen having the tubular base members 22, 24 supported on wheels 25. Again, a pair of vertical supports 31, 32 are connected to the patient support platform 41. A central post 253 having a slot 255 is located between the vertical supports 31, 32. The patient support platform 41 is connected by a bracket 256 to a central post 253. The bracket 256 is raised and lowered along the slot. The central post 253 is supported by a wheel 257 to enable the movement of the patient lifter from location to location. As the bracket reaches the bottom-most position of the slot 255, spaced above the floor by the presence of the wheel 257, the patient support platform 41 is in contact with the floor. The bracket 256 allows the patient support platform 41 to be in contact with the ground and below the end of the slot 255 by bridging this distance. Any conventional means, such as a motor, can be used for the raising and lowering of the bracket 256 within the slot 255 in order to effectuate the raising and lowering of the patient support platform 41.

FIG. 11 shows a variation of the central post in a fourth embodiment of the invention. In this embodiment, the central tower 357 has a base supporting three wheels 357. In this embodiment, the bracket 356 is positioned above the patient support platform 41. The vertical supports 331, 332 are pivotally connected to the bracket 356. Suspension supports 359 extend downwardly from the bracket 356 and connect to the patient support platform 41. With the lowering of the bracket 356, the vertical supports 331, 332 move outwardly and the patient support platform 41 is lowered to the floor. The bracket 356, in its lower-most position, is still some distance from the floor, necessitating the use of the suspension support 359 to insure that the patient support platform 41 rests on the floor.

A cable 361 runs between and is connected to the vertical supports 331, 332. The cables are connected to a winding mechanism 365. Operation of the winding mechanism causes the cable to be taken up into the winding mechanism and the effective length of the cable is reduced. This action causes the distance between the vertical supports to decrease and raises the patient support platform 341 upwards. Letting the cable out from the winding mechanism lowers the patient support mechanism to the floor. In this way, the cable performs the function that a piston had in the earlier embodiments, but is able to traverse a longer distance without the inherent problems such a long piston would encounter.

The side view of this embodiment is shown in FIG. 12 in its upright position. In this view, the suspension of the patient support platform 41 from the bracket 356 by the suspension support 359 is clearly seen. The lowered position is seen in FIG. 13 and it can be seen that the distance between the lower-most position of the bracket 356 and the patient support platform 41 is bridged by the suspension support 359. As in all embodiments, the wheels 25 change from a position underneath the tubular base member 324 to a position located to the side of the tubular base member 324.

Turning now to FIG. 14, a fifth embodiment of the patient lifter is depicted. In this embodiment, the patient lifter has tubular bases 422, 424 supported on wheels 25. A pair of vertical supports 431, 432 extend upwardly to a patient support platform 41. The patient support platform is raised and lowered by a gear train 453. There are four gears with two end gears and two middle gears. Each end gear is rigidly connected to one of the vertical supports 431, 432. The rigid connection insures that, as the gear rotates, the vertical support rotates with it. As the left-most gear turns clockwise, the vertical support 431 rotates clockwise. The next gear therefore moves counter-clockwise and the third gear moves clockwise. This causes the other end gear, rigidly attached to support 432 to move counter-clockwise. The vertical support 432 therefore rotates counter-clockwise, a direction opposite than the vertical support 431. With the rotation of the vertical supports, the patient support platform is lowered until it reaches the floor. Any conventional means can be used to rotate the gears and lock them in place to prevent rotation and secure the patent support platform 41 at any elevation.

FIGS. 15 and 16 show the patient lifter in the upright and lowered position, respectively. The various parts, as they appear in these two positions, are shown. As can be seen in FIG. 16, when in the lowered position, very little of the structure extends above the top surface of the patient support platform 41.

A sixth embodiment of the patient lifter is shown in FIG. 17. The patient lifter has a base with tubular base members 522, 524 supported on wheels 25 and connected to a telescopic cross member formed by middle section 525 and telescoping side members 526, 527. A single central support tower 563 extends from the central telescopic member 525. Telescoping tube 564 slides along the central vertical tower 563 and a pair of left support braces 571, 573 and right support braces 572, 574 extend from the telescoping tube 564. The upper left support brace 573 has one end attached to the top of the telescoping tube and extends outwardly and attaches to en end of the lower left support brace 571 having its opposite end pivotally connected to the central support tower 563. Likewise, the upper right support brace 574 has one end attached to the top of the vertical telescoping tube 564 and has its other end connected to an end of the lower right support brace 572. The lower right support brace has its remaining end attached to the central support tower 563. Connected to, and extending between, the juncture of the left support braces and right support braces, is an actuating piston 553. In a fully contracted position of the piston, the junctions of the left and right support braces are brought closer together and the telescoping tube 564 is in an upper position on the central vertical tower. As the actuating piston 553 increases in effective length, the junction between the left support braces and right support braces increases and the telescoping tube 564 assumes a lower position on the central vertical tower 563. Attached to the telescoping tube is the patient support platform 41. To complete the patient lifter, a pair of side supports 531, 532 extend from the left and right tubular base members 523, 524 to the top of the telescoping tube 564. Lowering of the patient support platform causes the tubular base members 522, 524 to move away from each other.

The patient lifter 510 in its upright position is shown in FIG. 18 and in its lower position in FIG. 19. As can be seen, the telescoping tube 564 travels along the vertical post 563 in order to raise and lower the patient support platform 41. The action of the piston 553 changes the geometry between the support braces in order to raise and lower the telescoping tube 564 along the central tower 563.

FIG. 20 shows a side view of an alternative base utilizing a single vertical central tower. The fully-extended position of the base is shown with the compacted position shown in phantom. In the compacted position, the patient support platform is in its raised position. The details of the base are more clearly seen with reference to FIG. 21, depicting a top view of the patient lifter. In this view, it can be seen that the base consists of a central section 625 and two L-shaped sections 622, 624, pivotally connected to each end of the central section. The central section supports a central vertical tower 653. As the patient support platform 41 is lowered, the L-shaped sections 622, 624 are pivoted so that the section initially perpendicular to the central section 625 becomes co-linear with the central section. This configuration allows sufficient clearance for the patient support platform to reach the floor without interfering with the base.

FIG. 22 shows a front view of a base having a vertical tower as would be used with the embodiment shown in FIG. 17. The mechanism for raising and lowering the patient support platform 41 is not shown. As can be seen, though, the patient support platform 41 is supported by, and travels along, a central vertical tower 753. The operation of the base is best seen with reference to FIG. 23, showing a top view of the patient lifter 710. The base has a central telescoping section having a central tube 723 with telescoping sections 725, 726 which move in and out of the central section 723 to increase the width of the base. Attached to the left telescoping section 725 is the L-shaped left base member 722. Similarly, attached to the right telescoping section 726 is the L-shaped base member 724. The telescoping sections 725, 726 can be extended outwardly from the central section 723 in order to increase the effective width of the base.

A ninth embodiment is shown in FIG. 24 having a base formed by a left member 822 and a right member 824 connected by a central member. The central member is formed by two sections 825, 827 connected to one another by a piston 853. A pair of crossed vertical members 831, 833 extend upwardly from the left and right base members 822, 824, respectively. The patient support platform 41 is supported by the crossing support members 831, 833. With actuation of the piston 853, the base members 822, 825 move apart from one another and the vertical height of the support members 831, 833 is decreased, lowering the elevation of the patient support platform 41.

Turning now to FIG. 25, the side view of the patient lifter 810 can be seen. Clearly seen is the manner in which the patient support platform 41 is suspended on the support members 831, 833. A bracket 851 extends upwardly from the patient support platform 41 and has a flange overlying and secured to the rounded top of the vertical members 831, 833. The vertical members 831, 833 move back and forth within the flange 851 as its vertical extent is increased and decreased by action of the piston 853. The fully lowered position of the patient lifter 810 is shown in FIG. 26.

Figure 27:
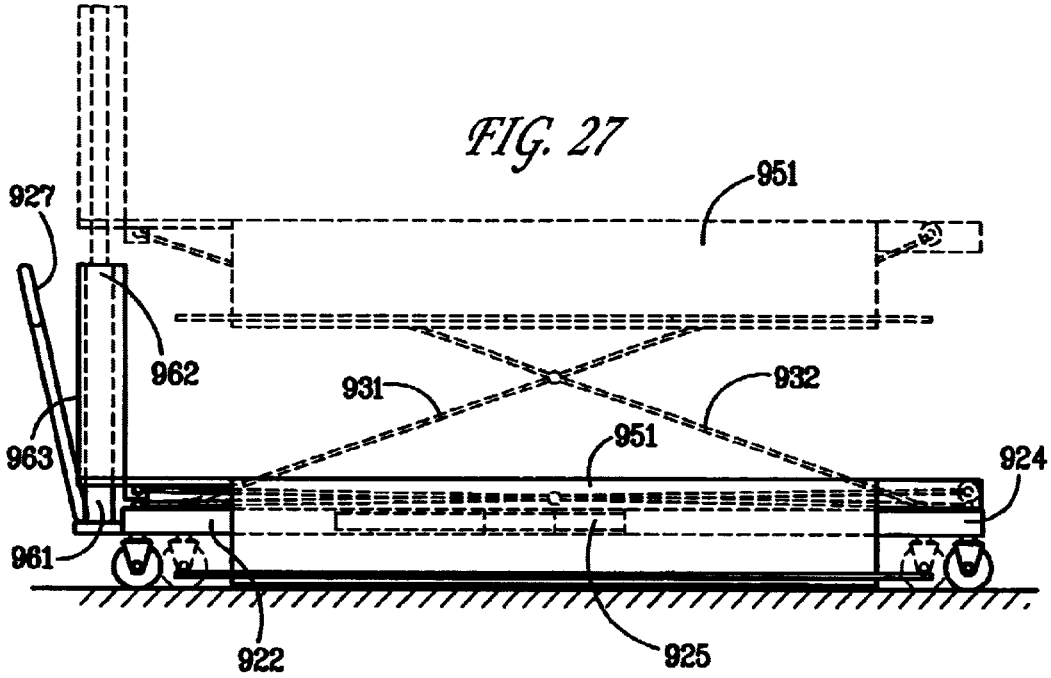
FIG. 27 is a front view of a tenth embodiment of the invention in the lowered position with the raised position shown in phantom.

A tenth embodiment is shown in FIG. 27. The patient lifter has tubular base members 922, 924 supported on wheels 25. A vertical tower 963 is attached to the side proximate the vertical base member 922. The vertical support tower 963 is formed by telescoping sections comprising inner tube 961 and outer tube 962. A pull handle 927 is pivotally attached near the bottom of the vertical support tower 963. The handle can be used when transporting the patient lifter from location to location.

A bracket 951 extends from the bottom of outer tube 962. The patient support platform 941 is suspended outwardly from the bracket 951. In order to raise and lower the patient support platform, a pair of scissor members 931, 932 are engaged in the bracket 951. The left ends of both the scissor members 931, 932 are fixed to the patient lifter, whereas the right side is free to move. The right side of scissor member 932 is pivotally attached to the right tubular base member 924. As the patient support platform 941 is lowered, the scissor member 932 causes the tubular base member 924 to move to the right. This is accomplished by a telescoping member forming the central base member 925 connected between the left and right tubular base members 922, 924. The right end of the scissor member 931 has a roller end that is engaged in, and slides within, bracket 951.

Figure 28:
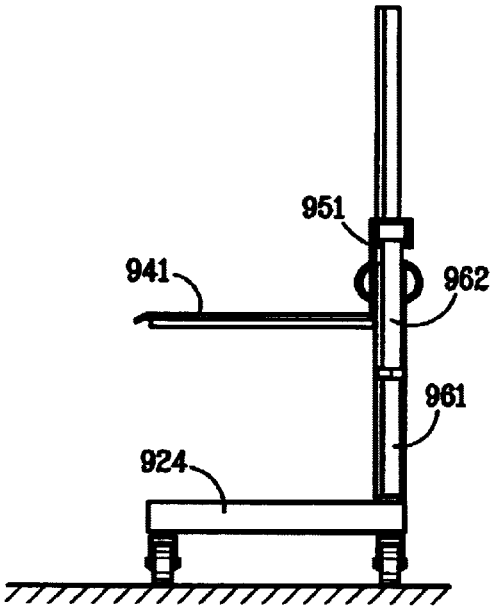
FIG. 28 is a side view of the tenth embodiment of the device in the upright position.
Figure 29:
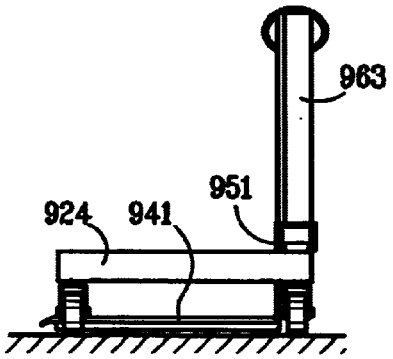
FIG. 29 is a side view of the tenth embodiment of the device in the lowered position.

The upright position of the patient lifter 910 is shown in FIG. 28 and the lowered position is shown in FIG. 29.

Figure 30:
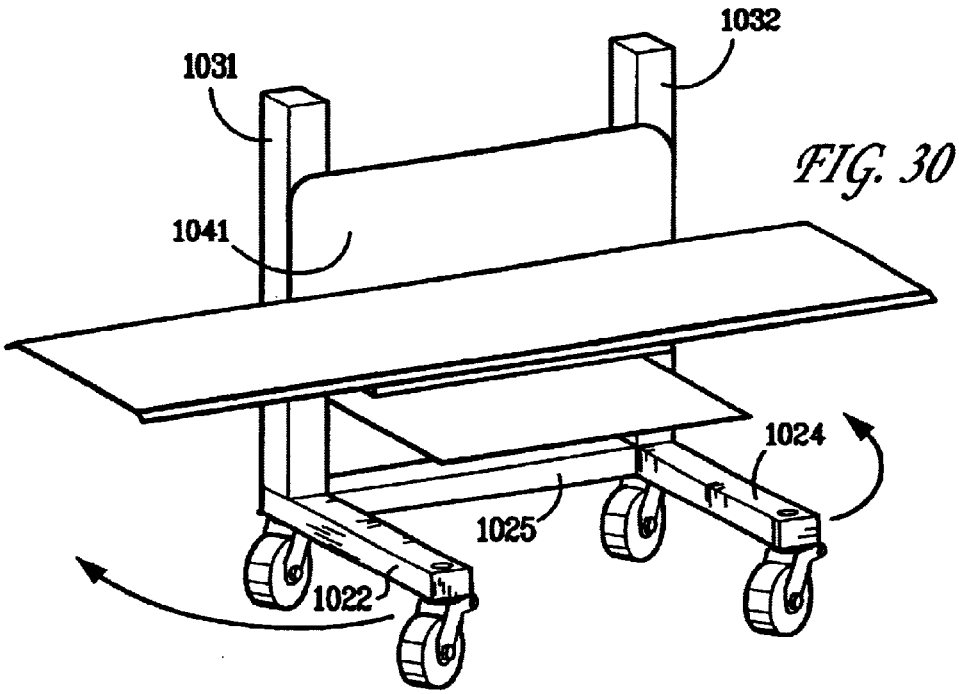
FIG. 30 is a front perspective view of an eleventh embodiment of the invention.

FIG. 30 is a front view of an eleventh embodiment of the invention. In this embodiment, the patient support platform is supported by two vertical towers 1031, 1032, each connected to a horizontally extending base member 1022, 1024. A central member 1025 connects the two vertical towers to one another at the juncture with the base members. The base members are connected to the central member by a hinge pin so that they can move from a position perpendicular to the central member to a position parallel with the central member. The patient support platform has an L-shaped plate 1041 extending between the vertical towers that provides support when the base members are co-linear with the central member. This plate is L-shaped, having a first section extending downwardly from the patient support platform and a second plate extending outwardly. The patient support platform can be moved along the central towers by any conventional means, such as cables.

Figure 31:
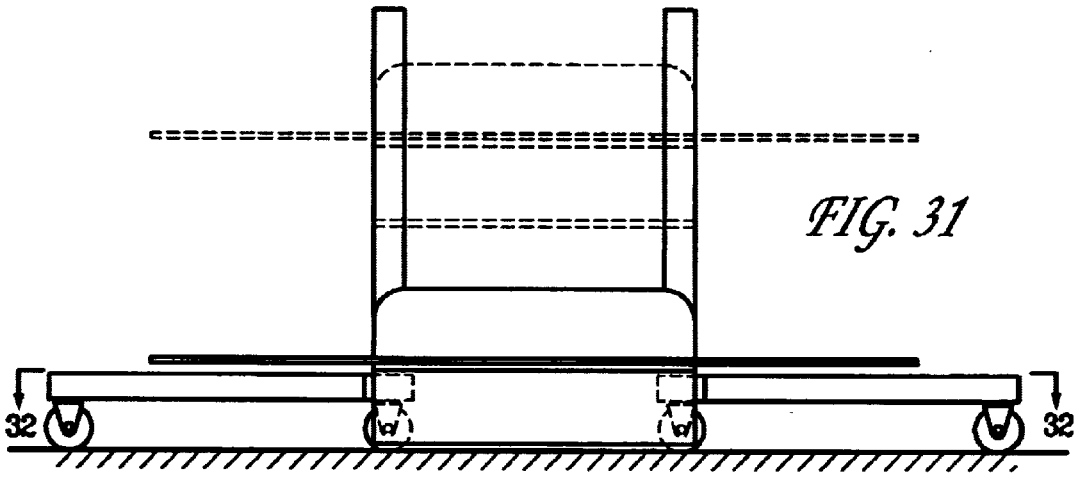
FIG. 31 is a front view of the patient support platform of the eleventh embodiment.
Figure 32:
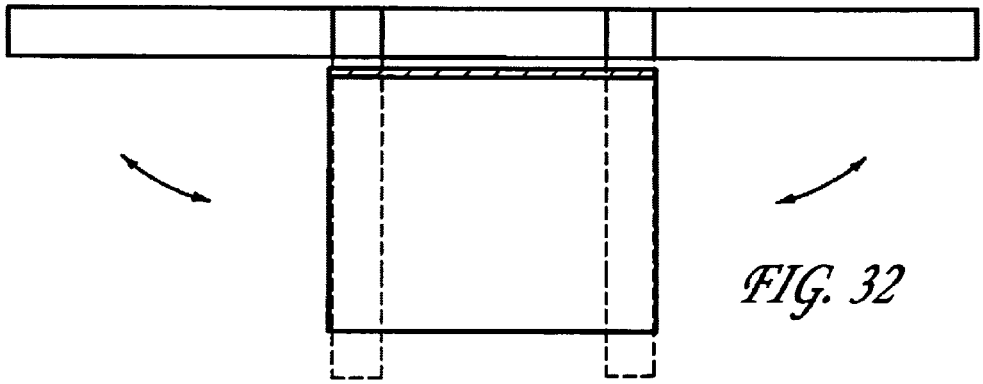
FIG. 32 is a top view of the eleventh embodiment of the device in the lowered position.

FIG. 31 shows the front view of the patient lifter. The L-shaped base plate supplies support when the base members are rotated to be co-linear with the central member. FIG. 32 shows the device in a lowered position with the base members co-linear with the central base member and the L-shaped plate providing support to the patient lifter.

FIG. 33 is a twelfth embodiment of the patient lifter which resembles the embodiments shown in FIG. 17–19. The only difference between the two embodiments is the lifting mechanism and therefore that is the only feature that will be described. In this embodiment, a lifting mechanism consists of a cable 561 extending from the top of the post 563 and about pulleys 565 and attaching to the juncture of the post 563 and cross-member 545. A winding mechanism 569 reduces the effective length of the cable and draws in the pulleys 565 towards one another. With this action, the pulleys are raised upwardly as that is necessary in order for the pulleys to become closer together. With this action, the junctions between the members 571–573 and 572–574 are also brought closer together and the bracket 564 is raised along with post 563.

While the invention has been described with reference to preferred embodiments, modifications or variations would be obvious to one of ordinary skill in the art. The invention encompasses such variations and modifications. For instance, the hydraulic pistons used in the invention can be replaced by an electric-driven screw mechanism.

I claim:

1. A patient lifter comprising:

a patient support for supporting a patient, at least one tower attached to said patient support, a base attached to said at least one tower for producing stability for said tower, said base comprising a straight central member having a first end and a second end and a first leg and a second leg, said first leg pivotably connected to said central member first end and said second leg pivotable connected to said central member second end, said two legs movable between a first position where said legs are parallel and a second position where said legs are collinear, a support plate mounted below said patient support, said support plate moveable relative to said at least one tower, said support plate stabilizing said patient lifter when said legs are moved from said first position to said second position, wherein said patient support is movable along said at least one tower.

2. The patient lifter of claim 1, further comprising a cross member extending between said two legs.

3. The patient lifter of claim 2, wherein said at least one tower is two towers.

4. The patient lifter of claim 1, wherein said at east one tower is two towers.

5. The patient lifter of claim 1, further comprising wheels attached to said base for allowing movement of said patient lifter.

6. The patient lifter of claim 5, wherein said wheels are attached to said legs.

* * * * *